US005501195A

United States Patent [19]

Hall

[11] Patent Number: 5,501,195

[45] Date of Patent: Mar. 26, 1996

[54] RETAINER ARRANGEMENT FOR A BOTTOM FEED FUEL INJECTOR

[75] Inventor: Bryan C. Hall, Newport News, Va.

[73] Assignee: Siemens Automotive Corporation, Auburn Hills, Mich.

[21] Appl. No.: 308,031

[22] Filed: Sep. 16, 1994

[51] Int. Cl.[6] ..... F02M 55/02

[52] U.S. Cl. ..... 123/470

[58] Field of Search ..... 123/468, 469, 123/470, 456; 239/600

[56] References Cited

U.S. PATENT DOCUMENTS

| | | | |
|---|---|---|---|
| 4,823,754 | 4/1989 | Minamoto et al. | 123/470 |
| 4,984,548 | 1/1991 | Hudson, Jr. | 123/468 |
| 4,991,557 | 2/1991 | DeGrace et al. | 123/470 |
| 4,993,390 | 2/1991 | Ono et al. | 123/468 |
| 5,035,224 | 7/1991 | Hornby et al. | 123/470 |
| 5,040,512 | 8/1991 | Twilton | 123/470 |
| 5,058,554 | 10/1991 | Takeda et al. | 123/456 |
| 5,074,269 | 12/1991 | Herbon et al. | 123/470 |
| 5,092,300 | 3/1992 | Imoehl et al. | 123/469 |
| 5,146,896 | 9/1992 | Imoehl et al. | 123/470 |
| 5,167,213 | 12/1992 | Bassler et al. | 123/470 |

*Primary Examiner*—Thomas N. Moulis
*Attorney, Agent, or Firm*—Russel C. Wells

[57] ABSTRACT

A clip is used to retain a bottom feed fuel injector in an injector seat cavity of a fuel rail, the clip having a pair of legs engaging the fuel rail and a bridging portion cutout to receive one side of the fuel injector to retain the fuel injector in the seat cavity. Various release devices allow convenient disengagement of the legs with fuel rail protrusions used to secure the legs in a first embodiment of the clip. The clip wraps around the fuel rail in a second embodiment.

8 Claims, 3 Drawing Sheets

RETAINER ARRANGEMENT FOR A BOTTOM FEED FUEL INJECTOR

BACKGROUND OF THE INVENTION

This invention concerns fuel injector installations for internal combustion engines. Fuel injectors are employed in modern internal combustion piston engines to deliver a charge of fuel by injection to each engine cylinder during each complete engine cycle.

Typically, such injectors have a generally cylindrical body, and are mounted at the top end to an auxiliary fuel delivery pipe branched off from a main fuel pipe. This arrangement is referred to as a "top feed" installation.

The injector is sometimes threaded into a seat in the auxiliary fuel pipe. U.S. Pat. No. 5,005,878 issued on Apr. 9, 1991, for a "Coupler Element" and U.S. Pat. No. 5,038,738 issued on Aug. 13, 1991, for a "Fuel Injection Device for Internal Combustion Engines" each describe an installation for the fuel injectors using a clip which engages the fuel injector and which has portions snapping over flanges on the auxiliary fuel pipe. In U.S. Pat. No. 4,823,754 issued on Apr. 25, 1989 for a "Retaining Apparatus for Fuel Injectors in Internal Combustion Engine" there is described a clip with inwardly extending flanges slidable in grooves formed on either side of the fuel rail.

The tendency for this design to malfunction under hot fuel conditions has led to the development of the so-called "bottom feed" (or side feed) injector installation, in which injector cavity seats are formed in the fuel rail which each receive an injector body, and fuel flows into a port on the side of the injector.

This arrangement has heretofore required the use of relatively complicated retainers involving the use of a bolt and washer with a clip. This increases the material costs and assembly time, and automated assembly is difficult.

The present invention seeks to provide a simplified retainer installation for bottom feed/side feed fuel injectors which minimizes the assembly labor required and is readily adapted to automated assembly.

SUMMARY OF THE INVENTION

According to the present invention, retention of the fuel injector is carried out by a clip which has a portion engaging the fuel injector body adjacent the top portion and which clip also includes a pair of legs which engage the fuel rail to secure the fuel injector in the seat cavity.

In a first embodiment, the legs each snap onto a protrusion on the exterior of a portion of the rail in which the cavity seat is formed which portion the legs straddle when the clip is installed.

A clip leg connector bridge is formed with a cutout into which is received one side of the fuel injector body, passing into a groove to hold the fuel injector body in its cavity seat by the engagement of the legs with the protrusion.

The injector and clip are then installed together when the injector is pushed into its fuel rail seat.

The legs can each be formed with latch mechanisms to allow convenient release from the protrusions or alternatively a tab portion can be provided to afford convenient release by use of a screwdriver.

In a second embodiment, the clip is installed separately from the side, and the legs and bridge portion are connected together to form a U-shape wrapped around one side of the fuel rail leg tips snapped over the opposite side of the fuel rail exterior.

For fuel rails having a draft angle, ribs may be needed to compensate for the draft angle to securely locate the inside of the clip against the outside of the fuel rail.

DETAILED DESCRIPTION

In the following detailed description, certain specific terminology will be employed for the sake of clarity and a particular embodiment described in accordance with the requirements of 35 USC 112, but it is to be understood that the same is not intended to be limiting inasmuch as the invention is capable of taking many forms and variation within the scope of the appended claims.

Figure 1:
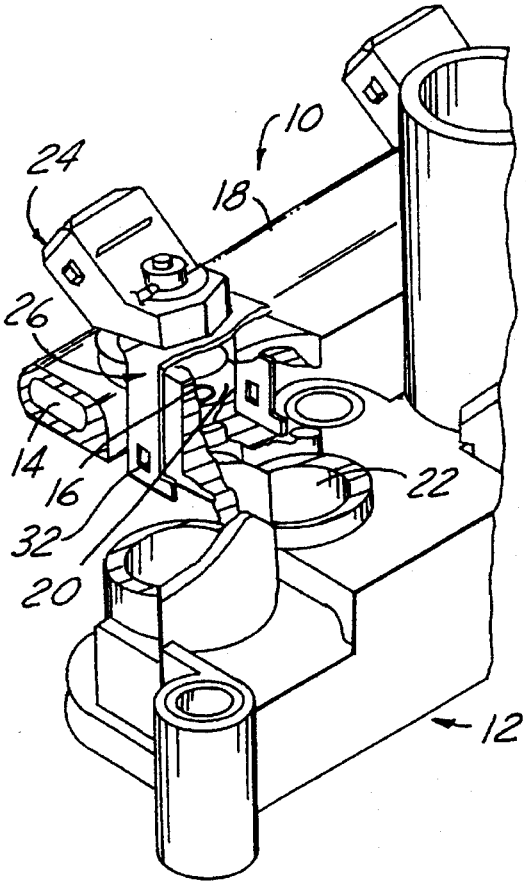
FIG. 1 is a fragmentary perspective view in partial section of a fuel rail intake manifold assembly showing a fuel injector installed with a retainer arrangement clip according to a first embodiment of the present invention.
Figure 2:
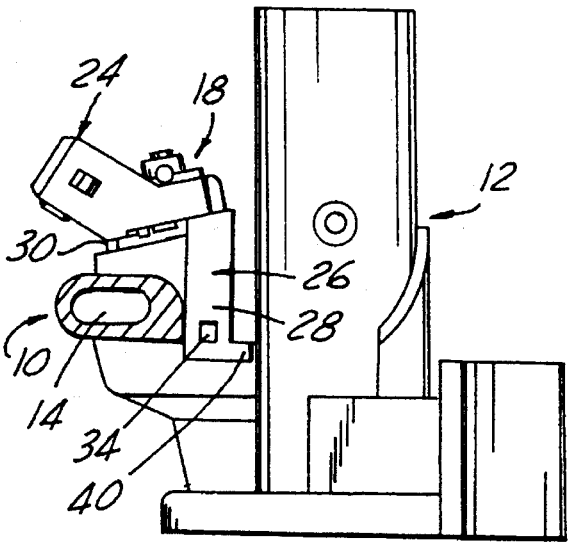
FIG. 2 is a side elevational view in partial section of the components shown in FIG. 1.

Referring to the drawings, and particularly FIGS. 1 and 2 a fuel rail 10 is shown an integral apart of an intake manifold 12. A fuel rail 10 is comprised of an elongated member formed with an internal cavity 14 through which the fuel passes being received from the engine fuel pump (not shown).

The fuel rail 10 also includes an injector cavity seat 16 into which is received a fuel injector 18. The fuel injector 18 includes a body 20 fit into the injector seat cavity 16 which includes porting (not shown) which allows the fuel to be received from the internal passage 14 of the fuel rail. The injector is adapted to be periodically opened to cause fuel to be injected into an intake manifold port 22, in the manner well known in the art.

The upper portion of the fuel injector 18 has a electrical connector 24 secured thereto to enable making the suitable electrical connection to the engine controls.

Figure 3:
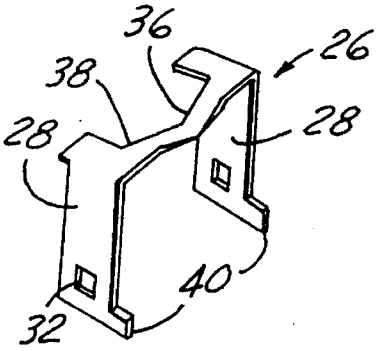
FIG. 3 is a perspective view of a fuel injector retention clip shown installed in FIGS. 1 and 2.

According to the concept of the present invention, the injector 18 is retained in the injector cavity seat 16 by a generally U-shaped clip 26, which is shown in perspective in FIG. 3.

The clip 26 is formed from flat stock spring steel, and has a pair of legs 28 which, when the clip is installed straddle the exterior of the rail portions defining the injector cavity seat 16. The legs 28 extend downwardly from the top surface 30 of the exterior of the injector cavity seat portion 16. Each leg 26 has an opening 32 which is snapped over a protrusion 34 molded or cast into the exterior of the fuel rail 10.

The clip 26 also includes a bridging portion 36 connecting the upper ends of the legs 28 extending orthogonally to each leg 28, and formed with a cut-out 38 which receives one side of the exterior of the fuel injector body 20 which in turn is formed with a suitable recess for this purpose.

The bridging portion 36 is angled to accommodate the inclination of the top surface 30 of the exterior of the fuel rail portion defining the injector seat cavity 16.

Projecting tabs 40 are also provided projecting at right angles to each leg 28 in order to facilitate removal by enabling prying of each leg 28 with a removal tool such as a screwdriver sufficiently to free engagement with the protrusions 34.

Figure 4:
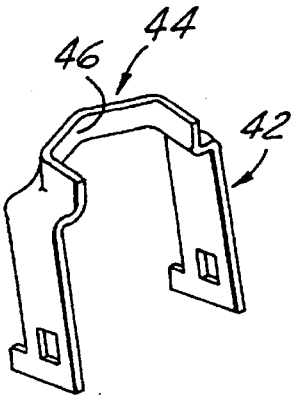
FIG. 4 is a perspective view of an alternate form of the clip shown in FIG. 3.

FIG. 4 shows an alternate form of the clip 42 in which a bridging portion 44 has an upwardly formed lip 46 adapted to be fit within a recess in the injector body 20 serving to strengthen and stiffen the clip for greater holding power.

Figure 5:
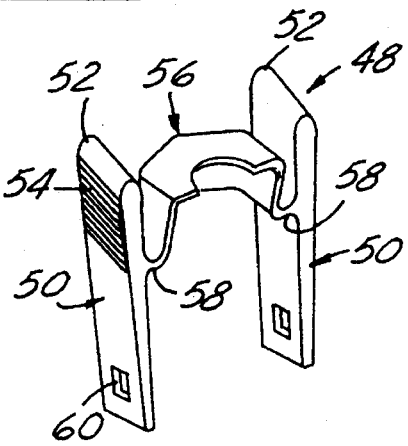
FIG. 5 is a perspective view of another alternate form of the clip shown installed in FIG. 1, constructed of molded plastic.

FIG. 5 shows an alternate form of the clip 48 of molded plastic as distinguished from the formed flat spring steel clips described above in which the legs 50 are each formed with an upper extension portion 52 suitably grooved having outer surface areas 54 to facilitate grasping with the fingers. Each of the legs 50 is connected to the bridging portion 56 by means of a bendable hinging section 58, such as to allow the legs 50 to be spread apart with finger pressure to displace the openings 60 mating with the protrusions on the fuel rail surface so as to disengage the same and allow convenient removal of the fuel injector 18 by release of the clip 48.

Figure 6:
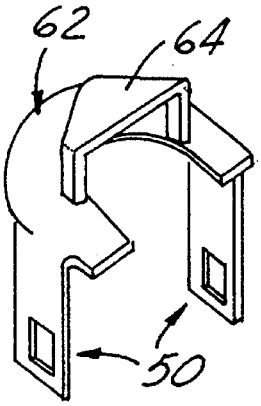
FIG. 6 is a perspective view of yet another alternate form of the clip shown installed in FIG. 1, which also could be made of plastic.

FIG. 6 shows yet another form of the clip 62 in which a cap portion 64 is provided which can partially overlie the top of the fuel injector to further increase the retention power of the clip 63.

Figure 7:
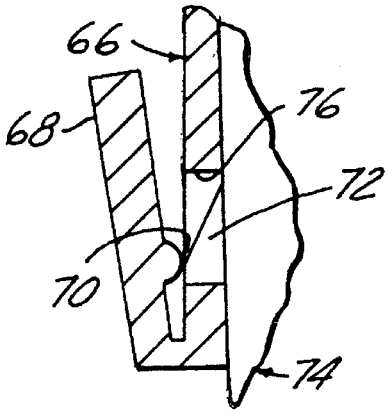
FIG. 7 is a fragmentary sectional view showing an alternate leg construction for a molded plastic form of the clip shown in FIG. 3 in the locked condition.
Figure 8:
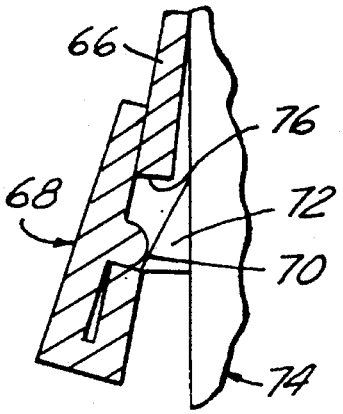
FIG. 8 is a view of the leg detail shown in FIG. 7 in the released condition.

FIGS. 7 and 8 show another form of a releasable latch feature in which each leg 66 is provided with a reversely extending end 68 which has an inwardly projecting protrusion 70 adapted to engage the protrusion 72 on the injector on the fuel rail exterior 74.

In the position shown in FIG. 7, the opening 76 in the legs 66 is securely in engagement with the protrusion 72 such as to hold the clip in the locked condition.

FIG. 8 shows the extension 68 pushed inwardly to contact the protrusion 70, bending the lower end of the leg 66 outwardly such as to move the opening 76 off the protrusion 72 and disengage the leg 66 from the fuel rail 74 as indicated. This eliminates the need for a screwdriver in order to release the clip from engagement and allow removal of the fuel injector.

Figure 9:
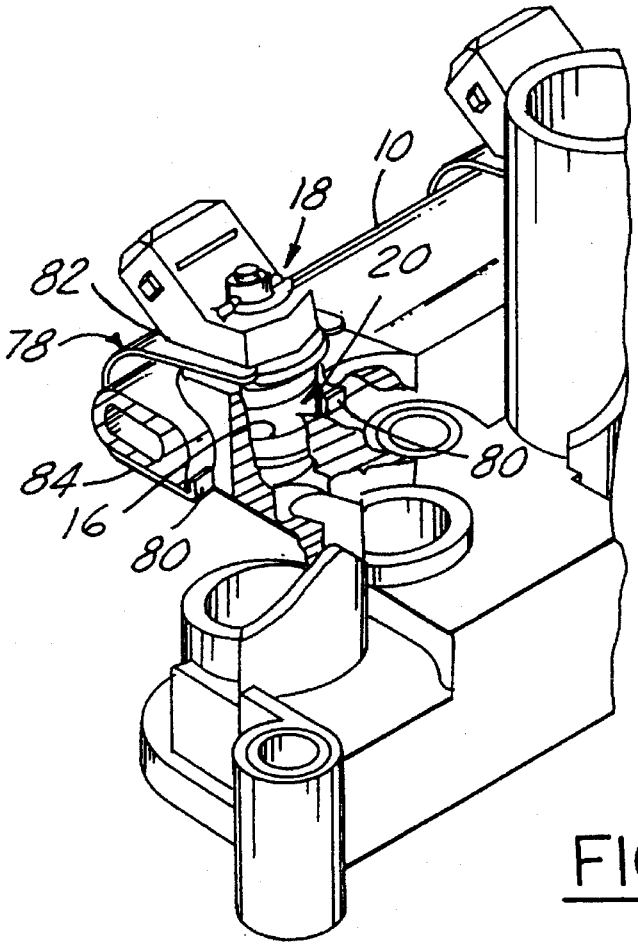
FIG. 9 is a fragmentary perspective view in partial section of a fuel rail intake manifold assembly showing a fuel injector installed using a retainer arrangement according to a second embodiment of the present invention.
Figure 10:
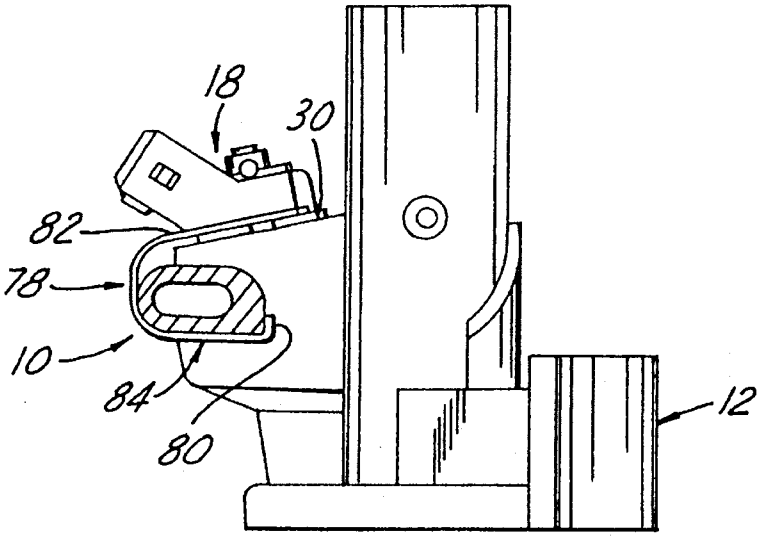
FIG. 10 is a side elevational view in partial section of the components shown in FIG. 9.

FIGS. 9 and 10 show a second embodiment of the retainer arrangement according to the present invention in which a U-shaped clip 78 is employed which wraps around one side of the fuel rail 10. The legs 90, 92 of a lower portion 84 extend around the fuel rail 10 and have up-turned tips 80 which hook onto the opposite side of the fuel rail. In this case, the clip 78 is preferably formed of heavier gage steel such as to be relatively stiff and resistant to spreading the upper and lower segments of the clip 82, 84 such as to hold the fuel injector 18 in its installed position.

Figure 11:
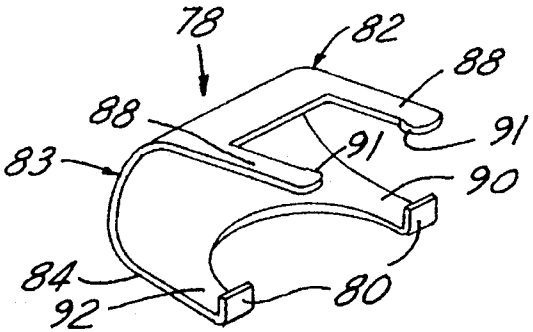
FIG. 11 is a perspective view of a fuel injector retention clip shown installed in FIGS. 9 and 10.

Referring to FIG. 11, the clip upper portion 82 includes spaced fingers 88 adapted to straddle the fuel injector body portion 20. Tip features 91 engage the body portion of the fuel injector 10 and are spread apart during transverse pressure applied during installation of the clip 78, thus to be retained on the fuel injector body 20.

The lower portion 84 fingers 90, 92 have the tips 80 upwardly bent 80 to snap over the opposite side of the fuel rail 10.

The inclination of the upper portion 82 is such as to match the inclination of the surface portion 30 forming the fuel rail exterior defining the injector cavity seat 16. In this case, the injector 18 may be installed in the injector cavity seat 16 first and then the clip 78 pushed onto the injector 18 and fuel rail 10 from the side.

Figure 12:
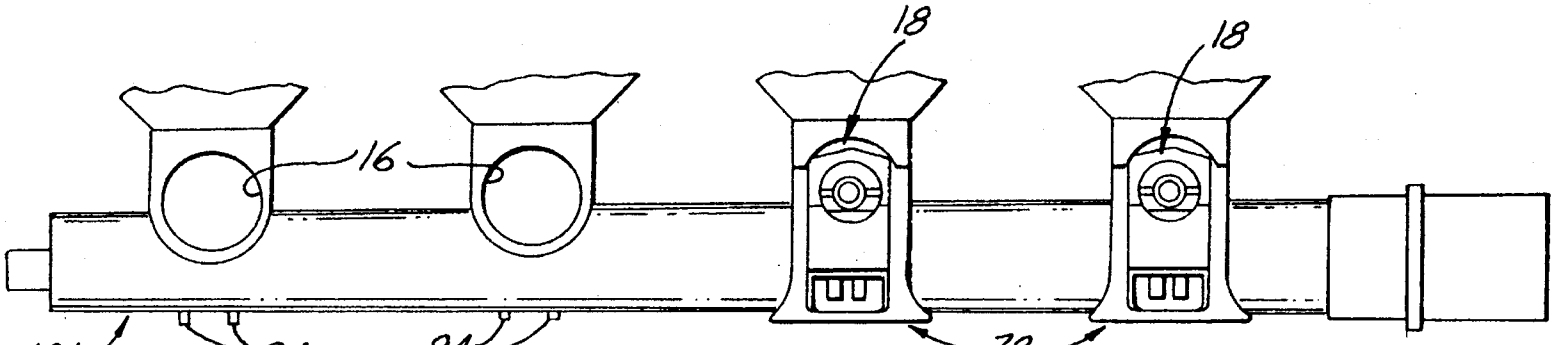
FIG. 12 is a plan view of a fuel rail having fuel injectors installed on two of the injector cavity seats showing draft angle compensation features.

FIG. 12 illustrates an additional feature which may be required with fuel rails 10A having a significant draft angle in order to have satisfactory, secure engagement of the clip 78 thereover. These features comprise vertical rib features 94 molded or otherwise formed into the outside surface of the fuel rail 10A aligned with each injector cavity 16 located such as to present a substantially vertical surface against which the clip 78 can abut when wrapped around the fuel rail 10.

Accordingly, it can be appreciated that the relatively simple clip configurations described can be installed without the need for tools, and when installed on the fuel rail provides an effective retainer arrangement for a bottom feed fuel injector which in most cases will require only a minor modification of the fuel rail shape.

I claim:

1. A retainer arrangement for a bottom feed fuel injector in which an elongated fuel injector body is received in an injector seat cavity formed in a portion of a fuel rail to receive fuel flow from an internal passage in said fuel rail through a port extending laterally into said fuel injector at a point intermediate the length of said fuel injector body, said retainer arrangement comprising:

a retainer clip having a pair of spaced apart elongated legs joined at one end by a bridging connector portion, the other end of each of said legs having an opening for engaging a respective protrusion on said fuel rail, said bridging connector portion shaped with a space to be received into a recess on one side of said fuel injector body, said clip is formed from strip material.

2. The retainer arrangement according to claim 1 wherein said bridging connector portion has a cutout configured to be fit to one side of said fuel injector body.

3. The retainer arrangement according to claim 1 further including latch release means associated with each of said legs to facilitate disengagement of each of said legs from said respective protrusion on said fuel rail.

4. The retainer arrangement according to claim 3 wherein said latch release means comprises a reversely extending portion on the other end of each leg formed with a protrusion facing said fuel rail protrusion to enable each of said other leg ends to be bent out by forcing said reversely bent portions inwardly to move said fuel rail protrusions off said leg openings.

5. The retainer arrangement according to claim 3 wherein said latch release means comprises tabs projecting laterally from each of said leg other ends to enable prying with a removal tool to release said leg other ends.

6. The retainer arrangement according to claim 3 wherein said latch release means comprises a leg extension extending from each said one end which can be squeezed together to move said leg openings off said fuel rail protrusions.

7. The retainer arrangement according to claim 1 wherein said clip is formed of sheet material and said connector portion defines a plane orthogonal to each of said legs which extend from a respective end of said bridging connector portion, said recess contoured into one side of said bridging connector portion.

8. The retainer arrangement according to claim 1 wherein said clip bridging portion has a portion adapted to extend over top of said fuel injector.

* * * * *